United States Patent [19]

Cottrell

[11] Patent Number: 4,569,898

[45] Date of Patent: Feb. 11, 1986

[54] PHOTOGRAPHIC FILM UNIT WITH PROTECTIVE, LIMITED SWELL POLYMER FOR SILVER HALIDE GRAINS

[75] Inventor: F. Richard Cottrell, South Easton, Mass.

[73] Assignee: Polaroid Corporation, Cambridge, Mass.

[21] Appl. No.: 674,409

[22] Filed: Nov. 23, 1984

[51] Int. Cl.[4] ..... G03C 5/54; G03C 1/96; G03C 1/04

[52] U.S. Cl. ..... 430/207; 430/230; 430/244; 430/248; 430/496; 430/531; 430/567; 430/627; 430/641

[58] Field of Search ..... 430/207, 227, 230, 228, 430/496, 567, 531, 627, 641, 248, 244, 523

[56] References Cited

U.S. PATENT DOCUMENTS

| | | | |
|---|---|---|---|
| 3,653,906 | 4/1972 | Wood | 430/531 |
| 3,674,482 | 7/1972 | Hablerin | 430/228 |
| 4,056,392 | 11/1977 | Scott | 430/228 |
| 4,353,977 | 10/1982 | Gerber et al. | 430/496 |
| 4,356,257 | 10/1982 | Gerber | 430/496 |
| 4,362,806 | 12/1982 | Whitmore | 430/496 |
| 4,366,227 | 12/1982 | Berger et al. | 430/228 |
| 4,366,235 | 12/1982 | Land | 430/496 |

*Primary Examiner*—Richard L. Schilling

[57] ABSTRACT

A photosensitive element comprising a support carrying a layer of photosensitive silver halide grains and a barrier polymer, said barrier polymer having a limited swell ratio in alkali; said barrier polymer being disposed substantially intermediate said silver halide grains and overlying said silver halide grains. In a preferred embodiment, the silver halide layer is a planar, spaced array of silver halide grains.

21 Claims, 2 Drawing Figures

PHOTOGRAPHIC FILM UNIT WITH PROTECTIVE, LIMITED SWELL POLYMER FOR SILVER HALIDE GRAINS

BACKGROUND OF THE INVENTION

Procedures for preparing photographic images in silver by diffusion transfer principles are well known in the art. For the formation of the positive silver images, a latent image contained in an exposed photosensitive silver halide emulsion is developed and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion and, substantially contemporaneous therewith, forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image. Procedures of this description are disclosed, for example, in U.S. Pat. No. 2,543,181 issued to Edwin H. Land. See also Edwin H. Land, *One Step Photography,* Photograhic Journal, Section A, pgs. 7–15, January 1950.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with the positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615,428; 3,615,429; and 3,894,871.

U.S. Pat. No. 3,674,482, issued July 4, 1972, is directed to a silver diffusion transfer film unit which comprises a support carrying on one surface, in order, a layer containing silver precipitating nuclei, an inert non-nuclei containing protective layer and a layer containing a photosensitive silver halide emulsion. The purpose of the nonnucleated protective layer is to provide a layer over the transferred silver image after the emulsion layer has been removed subsequent to processing, which protective layer will then be the outermost layer. The material for the protective layer is one which is readily permeable to the processing composition and which will not provide sites for the nucleation of the silver forming the transferred image. A particularly preferred material employed as a protective layer comprises chitosan (deacetylated chitin).

U.S. Pat. No. 4,056,392, issued Nov. 1, 1977, is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer, an increase in $D_{max}$ is achieved with substantially no adverse effect on $D_{min}$ compared to a protective layer composed of chitosan alone.

Film units which include a support carrying a diffusion transfer image receiving layer and a photosensitive layer may be constructed to provide for the separation of the photosensitive layer from the remainder of the film unit subsequent to exposure and processing by the employment of a release layer intermediate the image-receiving layer and the photosensitive layer. Such release layers are disclosed and claimed in U.S. Pat. No. 4,366,277, issued Dec. 28, 1982, to Michael Berger and John J. Magenheimer, and copending application Ser. No. 398,669, filed July 15, 1982, of Michael Berger, Warren J. Dillman and Herbert L. Fielding (common assignee).

U.S. Pat. No. 4,366,235, issued Dec. 28, 1982 to Edwin H. Land, is directed to a method for forming a predetermined, regular geometric spaced array of sites and then forming single effective silver halide grains at said sites. Thus, by forming the sites in a predetermined spatial relationship, if the silver halide grains are formed only at the sites, each of the grains will also be located at a predetermined and substantially uniform distance from the next adjacent grain, without touching the next adjacent grain, and their geometric layout will conform to the original configuration of the sites.

U.S. Pat. No. 4,356,257, issued Oct. 26, 1982 to Arthur M. Gerber, is directed to a method for forming a photosensitive element comprising a plurality of single effective silver halide grains, which method comprises coalescing fine-grain silver halide in a plurality of predetermined, regular, geometric spaced depressions. Preferably, the coalescence is effected by contacting fine-grain silver halide with a solution of a silver halide solvent.

U.S. Pat. No. 4,353,977, issued Oct. 12, 1983 to Arthur M. Gerber, Warren D. Slafer and Vivian K. Walworth, discloses and claims a process which employs a cover sheet comprising a hydrophilic layer in contact with the relief pattern during coalescence whereby single effective grains are retained on the hydrophilic layer subsequent to separation from the relief pattern.

U.S. Pat. No. 4,362,806, issued Dec. 7, 1982 to K. E. Whitmore, is directed to photographic elements having supports providing microcells for materials such as radiation sensitive meterials including silver halide grains, imaging materials, mordants, silver precipitating agents and materials which are useful in conjunction with these materials.

SUMMARY OF THE INVENTION

The present invention is directed to a photosensitive element comprising a support carrying a layer of photosensitive silver halide grains and a barrier polymer, said barrier polymer having a limited swell ratio in alkali, preferably less than 1.5; said barrier polymer being located over and intermediate said silver halide grains. The silver halide layer comprises a geometric, planar, spaced array of silver halide grains or a random array of silver halide grains having an associated gelatin level such that the dry thickness of the gelatin associated with the grains is less than 10% of the average grain thickness.

In a preferred embodiment, the photosensitive element is employed in a silver diffusion transfer film unit.

DETAILED DESCRIPTION OF THE INVENTION

Figure 1:
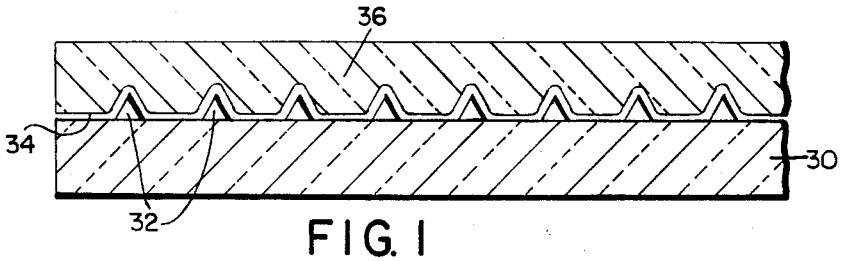
FIG. 1 is an exaggerated cross-sectional view of the photosensitive element of the present invention.

The advantages obtainable by forming photosensitive elements wherein the photosensitive silver halide grains are in a predetermined spaced array has been recognized by the art. See, for example, the Background of the Invention in U.S. Pat. No. 4,366,235, cited above. However, even though grains, or clusters of grains, may be spaced apart, a problem exists with respect to regional development, i.e., when silver halide development is not confined to the silver halide grains in which the latent image site is located. Adjacent grains are also developed as a result of their proximity to the grains containing the latent image and, in silver diffusion transfer systems, chemically developed grains act as sites for further physical development thereby "robbing" silver which would otherwise contribute to the positive silver image. This further physical development also increases the granularity of the system.

An additional problem exists in silver diffusion transfer film units with respect to lateral diffusion of the soluble silver complex; i.e., movement in the film unit of the soluble silver complex in a direction other than directly towards the image-receiving layer, which results in a loss of image quality. In an additive color diffusion transfer film unit such lateral diffusion of image silver also results in a loss of color quality.

By means of the present invention, regional development and, in the case of a silver diffusion transfer film system, lateral diffusion, are obviated both in a silver halide layer wherein the silver halide grains are disposed in a geometric, planar spaced array or in a random array of silver halide having an associated level of gelatin l such that the dry thickness of the gelatin is less than 10% of the average grain thickness.

Regional development and lateral diffusion are prevented by employing a barrier polymer intermediate and over the grains. The barrier polymer possesses a limited swell ratio in alkali. Swell ratio is defined as the change in volume of the polymer over the initial volume of the polymer. The term "limited swell ratio" as used herein is intended to refer to a swell ratio sufficient to prevent diffusion of dissolved photographic compounds; such as silver complexes, developers or oxidized developers depending upon the specific photographic system. The term "alkali" as used herein is intended to refer to alkaline conditions which produce a photographic useful pH suitable for carrying out the desired photographic processes. By employing barrier polymers with the defined limited swell ratio, the diffusion of certain moieties such as soluble silver complex through the polymer is inhibited or entirely prevented. In a preferred embodiment, the swell ratio is less than about 1.5. This level of swell ratio will inhibit the diffusion of most photographic moieties considered deletereous. However, it should be understood that the particular barrier polymer swell ratio can be selected to provide predetermined diffusion characteristics with specific photographic moieties in mind.

As examples of suitable barrier polymers mention may be made of the following:

sodium cellulose sulfate
poly-4-vinylpyridine
poly-2-vinylpyridine
propylene glycol alginate
manucol ester of alginic acid
60:30:4:6 butyl acrylate/diacetone acrylamide/-styrene/methacrylic acid copolymer latex
60:30:7:3 butyl acrylate/diacetone acrylamide/methacrylic acid copolymer latex
60–70:25–35:5–10 ethyl acrylate/methyl methacrylate/-partially methylolated methacrylamide copolymer latices
water-based polyurethane sold under the tradename NeoRez 960 by Polyvinyl Chemicals, Wilmington, MA
water-based polyurethane sold under the tradename IMPRINIL DLN and XW110 by Mobay Chemical Company, Pittsburg, PA
94–97:3–6 diacetone acrylamide/acrylic acid In the case of sodium cellulose sulfate, the desired swell ratio is achieved by contacting the polymer with potassium ions. In the case of propylene glycol alginate and the manucol ester of alginic acid, the low swell ratio is obtained by contacting the polymer with a multivalent metal ions such as calcium ions. Preferably, the barrier polymer is sodium cellulose sulfate.

In a preferred embodiment of the present invention, a support carries a silver precipitating layer, a non-nucleated layer, i.e., a protective layer devoid of silver precipitating nuclei which will function to protect the silver image deposited in the nucleated image-receiving layer when the developed photosensitive layer is removed but which will not prevent the passage of soluble silver complex therethrough; a photosensitive layer comprising a geometric planar spatial array of silver halide grains, and a layer of sodium cellulose sulfate intermediate said grains and overlying said grains. Subsequent to exposure the film unit is processed by applying an alkaline photographic processing composition to the film unit distal to the support. Upon contact with potassium ions, e.g., potassium hydroxide, an exchange with some of the sodium ions in the sodium cellulose sulfate occurs forming an irreversible gel of such low swell ratio as to provide a barrier to the passage of soluble silver complex. Since the sodium cellulose sulfate overlies the grains and is intermediate the grains the above-described regional development is prevented and only one diffusion path is available to the soluble silver complex; directly toward the silver precipitating layer.

The term "arrayed silver halide grains" as used herein is intended to refer to single effective grains as described in the Background of the Invention in U.S. Pat. Nos. 4,366,235; 4,356,257 and 4,353,977 and to a plurality of silver halide grains located in clusters or colonies wherein said clusters are in spaced apart, arrayed relationship with other clusters.

The arrayed grains may be deposited to form the film unit of the present invention employing the techniques disclosed in U.S. Pat. No. 4,353,977, incorporated by reference herein, wherein single effective grains formed in a relief pattern are transferred to a hydrophilic layer. Alternatively, in a preferred embodiment, a low gel silver halide emulsion is deposited in a relief pattern corresponding to the desired array of silver halide grains and then deposited on the non-nucleated layer employing the methods of U.S. Pat. No. 4,353,977 to provide the geometric, planar array of silver halide grains. Alternatively, gravure techniques can be employed to form the geometric, planar spaced array of silver halide grains.

In an alternative embodiment, the film unit of the present invention comprises a support carrying a silver precipitating layer, a non-nucleating layer, a photosensitive layer comprising a layer of gelatin and silver halide grains wherein the gelatin associated with the silver halide grains has a dry thickness of less than 10% of the average grain thickness, and a layer of sodium cellulose sulfate intermediate said grains and overlying said grains. By employing the described low gel emulsion, the silver halide grains are disposed in essentially a monolayer with the gelatin functioning as a "glue" to adhere the grains to the layer on which they are deposited. However, the gelatin level is such to provide open areas between individual grains which can be filled with a barrier polymer such as sodium cellulose sulfate, which can be converted to an irreversible gel thereby preventing lateral diffusion of the soluble silver complex during processing.

In employing a random array of silver halide with the low-gel content, it should be understood the grains must be disposed substantially in a monolayer. The exact amount of silver halide, of course, depends upon the size of the grains employed.

Since the action of potassium ions on the sodium cellulose sulfate is so rapid, care must be taken to ensure that sufficient developer contacts the silver halide grains prior to the formation of the irreversible gel which would present diffusion of the developer and other reagents.

In one embodiment, the developer is deposited in the silver halide layer or in a layer adjacent the silver halide layer but on the side of the sodium cellulose sulfate layer opposite the side first contacted by the processing composition.

The thickness of the barrier polymer layer may vary over a relatively wide range and is not critical. The coverage may be selected with respect to the requirements of a specific film unit. Generally, coverages in the range of about 90 to 560 mg/ft$^2$ and preferably 185 to 370 mg/ft$^2$ are employed in the case of sodium cellulose sulfate. It should be noted that, although reagent permeation, i.e., aqueous processing composition uptake rate, is decreased by the presence of sodium cellulose sulfate layer, the rate not significantly affected over this range of sodium cellulose sulfate coverage.

The molecular weight of the sodium cellulose sulfate is not critical and polymers over a wide range of molecular weight can be satisfactorily employed. For convenience in coating, however, a relatively low molecular weight material is employed, e.g., a weight average molecular weight of about 150,000. Similarly, the degree of sulfate substitution on the cellulose ring is not critical, however, to provide a sufficiently tough film, polymers with a degree of substitution of at least about 1.5 and preferably in excess of about 2.0 is employed.

Optionally, a material may be added to the sodium cellulose sulfate layer to increase permeability. As an example of such material mention may be made of polyacrylamide.

Turning now to the drawings, FIG. 1 is a cross-sectional view of a photosensitive element within the scope of the present invention. Support 30 carries a monolayer of silver halide grains 32 which have an associated dry gelatin layer which is less than 10% the thickness of the grains. Overlying and intermediate the grains is barrier polymer 36.

Figure 2:
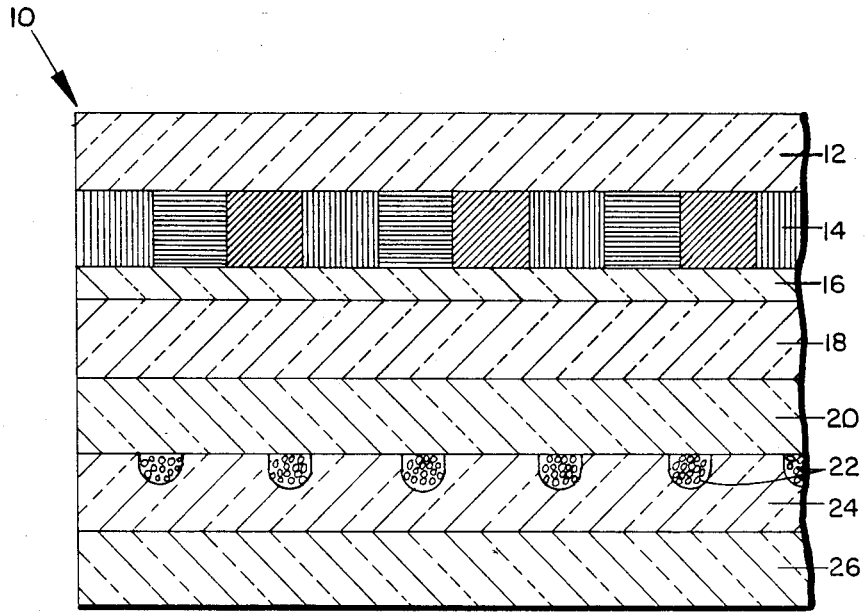
FIG. 2 is a cross-sectional view of a preferred embodiment of a film unit within the scope of the present invention.

In one embodiment, the film unit of FIG. 2 may have disposed in the silver halide lower a developer such as t-butyl hydroquinone or methylphenyl hydroquinone and a compound adapted to release silver halide solvent such as those disclosed in U.S. Pat. No. 3,932,480, issued Jan. 13, 1976. Development is initiated by contacting the exposed film unit with an aqueous alkaline solution. The potassium ions may be added as a part of the aqueous alkaline solution or as a subsequent solution. Subsequent to processing the negative is removed by contact with a stripping layer.

In FIG. 2, a preferred film unit within the scope of the present invention is shown. Film unit 10, comprises a transparent support 12 carrying on one side, in order, an additive trichromatic color screen 14, barrier layer 6 to protect the screen from the photographic processing composition, silver precipitating layer 18, non-nucleated protective layer 20, clusters of silver halide grains 22 in a geometric, planar spaced array, sodium cellulose sulfate 24, disposed intermediate said arrayed grains and overlying the array and top coat 26. In a particularly preferred embodiment, a strip layer (not shown) is employed intermediate the non-nucleated protective layer 20 and silver halide grains 22 and, subsequent to processing, the silver halide grains and all layers above the grains are removed, by for example, action of a stripping sheet.

It should be understood that the sodium cellulose sulfate is not intermediate the individual grains within the cluster but rather between the clusters.

The support employed in the present invention is not critical. The support or film base employed may comprise any of the various types of rigid or flexible supports. For example, glass, polymeric films of both the synthetic type and those derived from natural occurring products, including paper, may be employed. If a transparency is desired, a transparent support is employed; if a reflection print is desired, an opaque support is employed. Especially suitable materials comprise flexible transparent synthetic polymers such as polymethacrylic acid; methyl and ethyl esters; vinyl chloride polymers; polyvinyl acetals; polyamides such as nylon; polyesters such as the polymeric films derived from ethylene glycol terephthalic acid; polymeric cellulose derivitives such as cellulose acetate propionate; polycarbonates; polystyrenes and the like.

The additive color screen employed in the present invention may be formed by techniques well known in the art; for example, by sequentially printing the requisite filter patterns by photomechanical methods. An additive color screen comprises an array of sets of colored areas or filter elements usually from 2–4 different colors, each of said sets of colored areas being capable of transmitting visible light within a predetermined wavelength range. In the most common situations, the additive color screen is trichromatic and each set of color filter elements light within one of the so called primary wavelength ranges, i.e., red, green, or blue. The additive color screen may be composed of minute dyed particles such as starch grains or hardened gelatin particles intermixed and interspersed in a regular or random arrangment to provide a mosaic. A regular mosaic of this type may be made by an alternating embossing and doctoring technique described in U.S. Pat.

No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1958 to Edwin H. Land, or pseudouracils, such as the 4,6-dihydroxypyrimidines as taught in U.S. Pat. No. 4,126,459, issued Nov. 21, 1978. While the silver halide solvent is preferably initially present in the processing composition, it is within the scope of this invention to initially position the silver halide solvent in a layer of the film unit, preferably in the form of a precursor which releases or generates the silver halide solvent upon contact with an alkaline processing fluid, for example, those compounds disclosed and claimed in U.S. Pat. No. 3,932,480, issued Jan. 13, 1976 to J. Michael Grasshoff and Lloyd D. Taylor.

The processing composition may contain a thickening agent, such as an alkali metal carboxymethyl cellulose or hydroxyethyl cellulose, in a quantity and viscosity grade adapted to facilitate application of the processing composition. The requisite alkalinity, e.g., a pH of 12–14, is preferably imparted to the processing composition, by employing, for example, sodium, and/or lithium hydroxide.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to removed unused silver halide developing agent, development rection products, etc., the silver halide developing agent(s) should not give rise to colored reaction products which might stain the image or which, either unreacted or reacted, might adversely affect the stability and sensitometric properties of the final image. Particularly useful silver halide developing agents have good stability in alkaline solution are substituted reductic acids, particuarly tetramethyl reductic acid, as disclosed in U.S. Pat. No. 3,615,440 issued Oct. 26, 1971 to Stanley M. Bloom and Richard D. Cramer, and, $\beta$-enediols as disclosed in U.S. Pat. No. 3,730,716 issued to Edwin H. Land, Stanley M. Bloom and Leonard C. Farney on May 1, 1973.

What is claimed is:

1. A photosensitive element comprising a support carrying a photosensitive layer and a barrier polymer; said photosensitive layer comprising silver halide grains in geometric, planar, spaced array of silver halide grains or a random array of silver halide grains having an associated gelatin level such that the dry thickness of said gelatin is less than 10% of the average grain thickness; said barrier polymer located intermediate said grains and overlying said grains, said barrier polymer being permeable to aqueous alkaline photographic processing composition but having a swell ratio in alkali of less than about 1.5.

2. The product of claim 1 wherein said silver halide grains are in a predetermined, geometric planar spaced array.

3. The product of claim 1 wherein said photosensitive layer has a silver halide developer disposed therein.

4. The product of claim 1 wherein said barrier polymer is sodium cellulose sulfate.

5. The product of claim 4 wherein said sodium cellulose sulfate is about 90 to 560 mg/ft$^2$ in thickness.

6. The product of claim 5 wherein said sodium cellulose sulfate is about 185 to 370 mg/ft$^2$ in thickness.

7. A silver diffusion transfer film unit comprising a support carrying, in order, a silver precipitating layer, a non-nucleated layer, a photosensitive layer and a barrier polymer, said photosensitive layer comprising silver halide grains in a geometric, planar spaced array or a random array of silver halide grains having an associated gelatin level such that the dry thickness of said gelatin is less than 10% of the average grain thickness; said barrier polymer located intermediate said grains and overlying said grains; said barrier polymer being permeable to aqueous alkaline photographic processing composition but having a swell ratio in alkali of less than about 1.5.

8. The film unit of claim 7 wherein said silver halide grains are in a predetermined geometric planar spaced array.

9. The film unit of claim 7 wherein said photosensitive layer has disposed therein a silver halide developer and a compound adapted to release silver halide solvent.

10. The film unit of claim 7 wherein said support is transparent.

11. The film unit of claim 9 which includes an additive color screen.

12. The film unit of claim 7 wherein said barrier polymer is sodium cellulose sulfate.

13. The film unit of claim 12 wherein said sodium cellulose sulfate is about 90 to 560 mg/ft$^2$ in thickness.

14. The film unit of claim 12 wherein said sodium cellulose sulfate is about 185 to 370 mg/ft$^2$ in thickness.

15. The film unit of claim 7 which includes a release layer intermediate said non-nucleated layer and said photosensitive silver halide layer.

16. The film unit of claim 7 wherein said photosensitive layer includes a silver halide developing agent.

17. The film unit of claim 7 which includes a layer containing an antihalation compound.

18. A photographic process which comprises the steps of:

(a) exposing a film unit comprising a support carrying, in order, a silver precipitating layer, a non-nucleated layer, a photosensitive layer comprising silver halide grains in a geometric, planar space array or a random array of silver halide grains having an associated gelatin level such that the dry thickness of said gelatin is less than 10% of the average thickness of said grains and a layer of sodium cellulose sulfate, said sodium cellulose sulfate being disposed intermediate said grains and overlying said grains;

(b) contacting said exposed photosensitive layer with a silver halide developing agent and a silver halide solvent adapted to provide a positive silver image in said layer comprising said silver precipitating layer; and contacting said sodium cellulose sulfate layer with sufficient potassium ions to convert said sodium cellulose sulfate to an irreversible gel.

19. The process of claim 18 which includes the step of removing said photosensitive layer subsequent to positive image formation.

20. A photosensitive element comprising a support carrying a photosensitive layer and a barrier polymer; said photosensitive layer comprising silver halide grains in a random array of silver halide grains having an associated gelatin level such that the dry thickness of said gelatin is less than 10% of the average grain thickness; said barrier polymer located intermediate said grains and overlying said grains, said barrier polymer permeable to aqueous alkaline photographic processing composition but having a swell ratio in alkali of less than about 1.5.

21. A silver diffusion transfer film unit comprising a support carrying, in order, a silver precipitating layer, a non-nucleated layer, a photosensitive layer and a barrier polymer, said photosensitive layer comprising in a random array of silver halide grains having an associated gelatin level such that the dry thickness of said gelatin is less than b 10% of the average grain thickness; said barrier polymer located intermediate said grains and overlying said grains; said barrier polymer being permeable to aqueous alkaline photographic processing composition but having a swell ratio in alkali of less than about 1.5.

* * * * *